US007878017B2

(12) United States Patent
Yasutomi

(10) Patent No.: US 7,878,017 B2
(45) Date of Patent: Feb. 1, 2011

(54) INDOOR UNIT OF AIR CONDITIONER

(75) Inventor: Masanao Yasutomi, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 298 days.

(21) Appl. No.: 11/665,366

(22) PCT Filed: Oct. 11, 2005

(86) PCT No.: PCT/JP2005/018685

§ 371 (c)(1),
(2), (4) Date: Apr. 13, 2007

(87) PCT Pub. No.: WO2006/048994

PCT Pub. Date: May 11, 2006

(65) Prior Publication Data

US 2007/0261425 A1 Nov. 15, 2007

(30) Foreign Application Priority Data

Nov. 8, 2004 (JP) ..... 2004-323861

(51) Int. Cl.
*F25D 23/12* (2006.01)

(52) U.S. Cl. ..... 62/263; 62/259.1; 62/426; 236/91 D

(58) Field of Classification Search ..... 62/263, 62/259.1, 426; 236/91 D
See application file for complete search history.

(56) References Cited

U.S. PATENT DOCUMENTS 6,189,328 B1 * 2/2001 Mochizuki ..... 62/298
6,725,684 B2 4/2004 Lee et al.

FOREIGN PATENT DOCUMENTS

| | | | |
|---|---|---|---|
| CN | 1403748 | A | 3/2003 |
| EP | 1271065 | A2 | 1/2003 |
| JP | 06-341671 | A | 12/1994 |
| JP | 07-98129 | A | 4/1995 |
| JP | 2003065558 | * | 3/2003 |
| KR | 0120742 | Y1 | 8/1998 |
| KR | 20-0146096 | Y1 | 6/1999 |
| KR | 2003-0083190 | A | 10/2003 |
| KR | 10-2004-0069655 | | 8/2004 |

* cited by examiner

*Primary Examiner*—Cheryl J Tyler
*Assistant Examiner*—Jonathan Koagel
(74) *Attorney, Agent, or Firm*—Global IP Counselors

(57) ABSTRACT

A wall-hung type indoor unit includes a casing having an air inlet for indoor air at a front side thereof, and a receiving element provided at a lower portion of the casing and configured to receive a signal transmitted from a remote controller. The casing having a first surface facing the receiving element. The first surface is inclined upward so as to form an angle α of 30 degrees or less with respect to a horizontal plane in a state in which the casing is attached to the wall. The receiving element is disposed such that a centerline of the receiving element is inclined with respect to an orthogonal plane perpendicular to the first casing surface. The centerline is directed diagonally downward.

15 Claims, 11 Drawing Sheets

INDOOR UNIT OF AIR CONDITIONER

CROSS-REFERENCE TO RELATED APPLICATIONS

This U.S. National stage application claims priority under 35 U.S.C. §119(a) to Japanese Patent Application No. 2004-323861, filed in Japan on Nov. 8, 2004, the entire contents of which are hereby incorporated herein by reference.

TECHNICAL FIELD

The present invention relates to an indoor unit of an air conditioner. More specifically, the present invention relates to a wall-hung type indoor unit of an air conditioner.

BACKGROUND ART

As one type of indoor unit that constitutes a separate type air conditioner, there is known a wall-hung type indoor unit attached to an upper portion of a wall of a room. This wall-hung type indoor unit is provided with a receiving device comprising infrared receiving elements and the like for receiving a signal transmitted from a remote controller such that the indoor unit can be operated by the remote controller. The receiving device is usually provided to be directed in the forward direction of the indoor unit so as to be able to secure a reception distance when the indoor unit is operated by the remote controller, in view of that a room occupant will operate the indoor unit by using the remote controller from a diagonally lower position in front of the indoor unit.

Incidentally, as disclosed in Japanese Patent Application Publication No. H7-98129, there is also provided a wall-hung type indoor unit having a structure in which a front panel capable of opening and closing an air inlet provided is at the front side of a casing.

SUMMARY OF THE INVENTION

When a structure provided with a front panel that can be opened and closed is employed, as is the case of the wall-hung type indoor unit as shown in Patent Document 1, it is inevitable to dispose the receiving device at a lower portion of the casing. Moreover, depending on the size of the front panel, there may be a case where the receiving device has to be disposed at a bottom side of the casing or in the vicinity thereof.

When such a structure provided with the front panel that can be opened and closed is employed, or when the receiving device has to be disposed at the bottom portion of the casing or in the vicinity thereof depending on the configuration of the indoor unit, such as the shape of the indoor unit or the restriction in equipment arrangement, a problem is caused that a signal transmitted from the remote controller cannot be reliably received by the receiving device.

In addition, in the vicinity of the receiving device, there is usually provided an operating device including an indicating device comprising LEDs and the like for displaying the operational status and buttons and the like for operating the air conditioner in the case where the remote controller is lost. These equipments also need be disposed at the bottom portion of the casing or in the vicinity thereof, which consequently limits the layout space. In particular, since visibility needs to be secured for the indicating device, there are many restrictions in arrangement of the indicating device at the bottom portion of the casing or in the vicinity thereof.

It is an object of the present invention to provide a wall-hung type indoor unit of an air conditioner in which a signal transmitted from a remote controller can be reliably received by a receiving device even when the receiving device has to be disposed at a bottom side of the indoor unit or in the vicinity thereof because of the configuration of the indoor unit.

An indoor unit of an air conditioner according to a first aspect of the present invention is a wall-hung type indoor unit of an air conditioner, comprising a casing attached on a wall of a room and having an air inlet for indoor air at a front side of the thereof, and a receiving device provided at a lower portion of the casing and configured to receive a signal transmitted from a remote controller. A first surface, which is a surface of the casing facing the receiving device, is inclined upward so as to form an angle of 30 degrees or less with respect to a horizontal plane in a state in which the casing is attached to the wall. The receiving device is disposed such that the centerline of the receiving device is inclined to a plane perpendicular to the first surface and is also directed diagonally downward.

With this indoor unit of the air conditioner, the receiving device is provided facing the first surface inclined upward so as to form an angle of 30 degrees or less with respect to the horizontal plane, and the receiving device is disposed such that the centerline of the receiving device is inclined to the plane perpendicular to the first surface and is also directed diagonally downward. Thus the centerline of the receiving device is directed in the forward direction of the casing. Accordingly, even when the receiving device has to be disposed at the bottom portion of the indoor unit or in the vicinity thereof because of the configuration of the indoor unit, a signal transmitted from the remote controller can be reliably received by the receiving device.

An indoor unit of an air conditioner according to a second aspect of the present invention is the indoor unit of the air conditioner according to the first aspect of the present invention, further comprising a front panel provided so as to cover the front side of the casing from one end to the other end and configured to open the air inlet by moving forward of the casing during operation.

With this indoor unit of the air conditioner, since the front panel is provided so as to cover the front side of the casing from one end to the other end, it is inevitable to dispose the receiving device at the lower portion of the casing. Further, there is a case where the receiving device has to be provided such that the receives face the first surface inclined upward so as to form an angle of 30 degrees or less with respect to the horizontal plane at the bottom side of the indoor unit or in the vicinity thereof. However, with this indoor unit of the air conditioner, even when the receiving device is provided so as to face the first surface inclined upward so as to form an angle of 30 degrees or less with respect to the horizontal plane, since the receiving device is disposed such that the centerline of the receiving device is inclined to the plane perpendicular to the first surface and is also directed diagonally downward, the centerline of the receiving device is directed in the forward direction of the casing. Thus, a signal transmitted from the remote controller can be reliably received by the receiving device.

An indoor unit of an air conditioner according to a third aspect of the present invention is the indoor unit of the air conditioner according to the first aspect or the second aspect of the present invention, further comprising an indicating device disposed in the vicinity of the receiving device and configured to display the operating state. The receiving device is disposed behind the indicating device.

With this indoor unit of the air conditioner, the receiving device is disposed behind the indicating device, in other words, the indicating device is disposed in front of the receiving device, and thereby the centerline of the receiving device can be directed in the forward direction of the casing while securing the visibility of the indicating device.

An indoor unit of an air conditioner according to a fourth aspect of the present invention is the indoor unit of the air conditioner according to the second aspect of the present invention, further comprising an indicating device disposed in the vicinity of the receiving device and configured to display the operating state. The receiving device is disposed behind the indicating device. The front panel is structured such that its lower end extends to the vicinity of the indicating device. The receiving device is configured such that its lower end is disposed behind the lower end of the front panel.

With this indoor unit of the air conditioner, the receiving device is disposed behind the indicating device, in other words, the indicating device is disposed in front of the receiving device, and thereby the centerline of the receiving device can be directed in the forward direction of the casing while securing the visibility of the indicating device. In addition, with this indoor unit of the air conditioner, since the distance in a front-back direction between the lower end of the front panel and the lower end of the receiving device can be increased, a signal transmitted from a remote controller can be reliably received.

An indoor unit of an air conditioner according to a fifth aspect of the present invention is the indoor unit of the air conditioner according to the third aspect or the fourth aspect of the present invention, wherein the receiving device is mounted on a first substrate. The indicating device is mounted on a second substrate different from the first substrate.

With this indoor unit of the air conditioner, the receiving device and the indicating device are mounted on the different substrates, and thus flexibility in installation of each substrate increases. Therefore, it is easy to dispose the receiving device such that the centerline of the receiving device is inclined to the plane perpendicular to the first surface and is also directed diagonally downward.

An indoor unit of an air conditioner according to a sixth aspect of the present invention is the indoor unit of the air conditioner according to the fifth aspect of the present invention, wherein the first substrate is disposed so as to be inclined with respect to the second substrate.

With this indoor unit of the air conditioner, since the first substrate is inclined with respect to the second substrate, the receiving device can be disposed such that the centerline of the receiving device is inclined to the plane perpendicular to the first surface and is also directed diagonally downward, without changing the shape of the receiving device.

An indoor unit of an air conditioner according to a seventh aspect of the present invention is the indoor unit of the air conditioner according to the sixth aspect of the present invention, wherein the first substrate is inclined with respect to the second substrate so as to be directed upward toward the front.

An indoor unit of an air conditioner according to an eighth aspect of the present invention is the indoor unit of the air conditioner according to the sixth or the seventh aspect of the present invention, wherein a front end portion of the first substrate is disposed at a position further from the first surface, compared to a rear end portion of the second substrate.

An indoor unit of an air conditioner according to a ninth aspect of the present invention is the indoor unit of the air conditioner according to any of the fifth aspect to the eighth aspect of the present invention, wherein an operating device for operating the air conditioner is further mounted on the second substrate.

With this indoor unit of the air conditioner, since the operating device is mounted on the substrate on which the indicating device is mounted, the layout space of the operating device and the indicating device can be reduced.

DETAILED DESCRIPTION OF THE INVENTION

An embodiment of an indoor unit of an air conditioner according to the present invention is described below with reference to the drawings.

(1) STRUCTURE OF THE INDOOR UNIT OF AIR CONDITIONER

Figure 1:
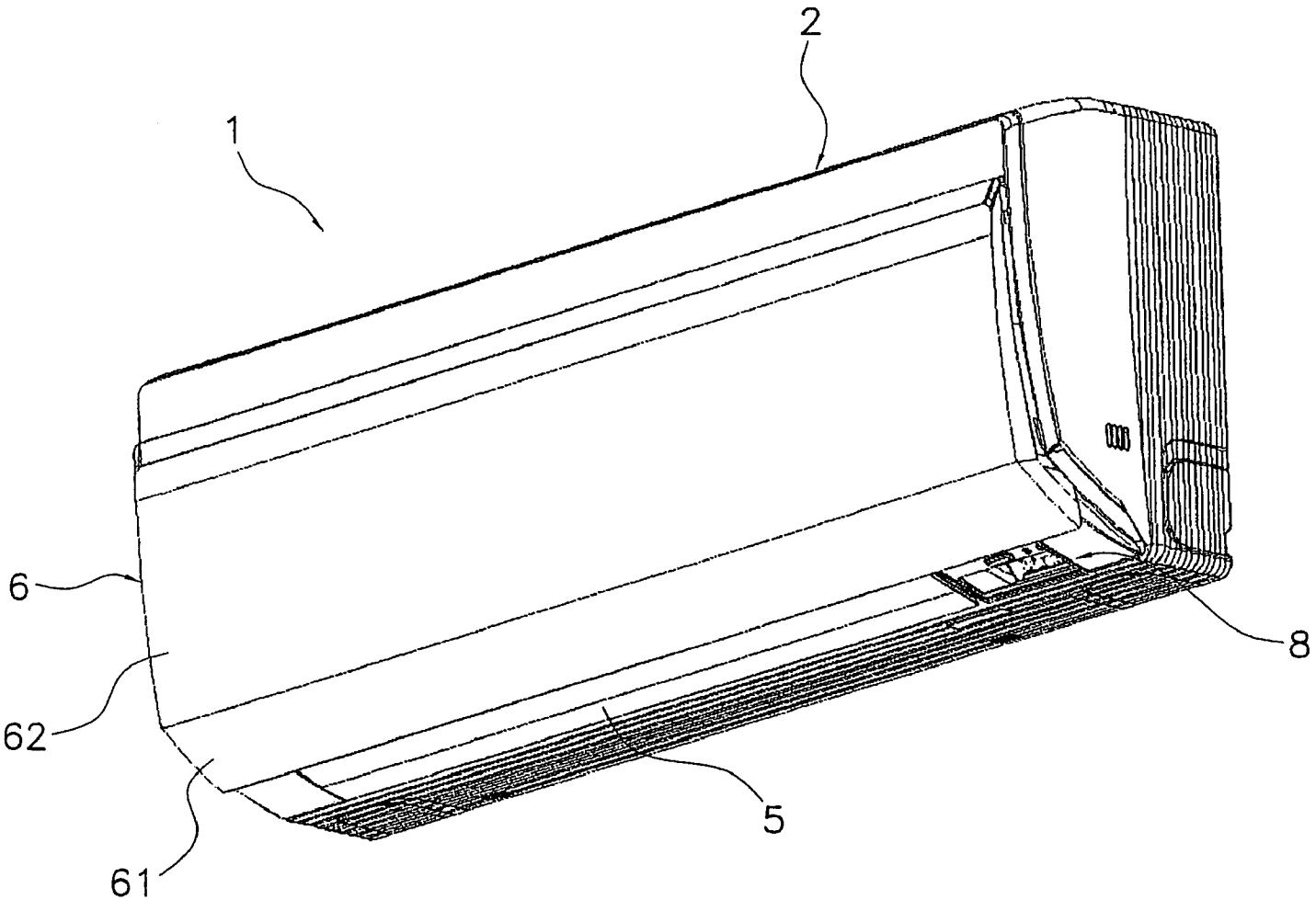
FIG. 1 is an external perspective view of an indoor unit of an air conditioner according to an embodiment of the present invention viewed from the diagonally right lower side.
Figure 2:
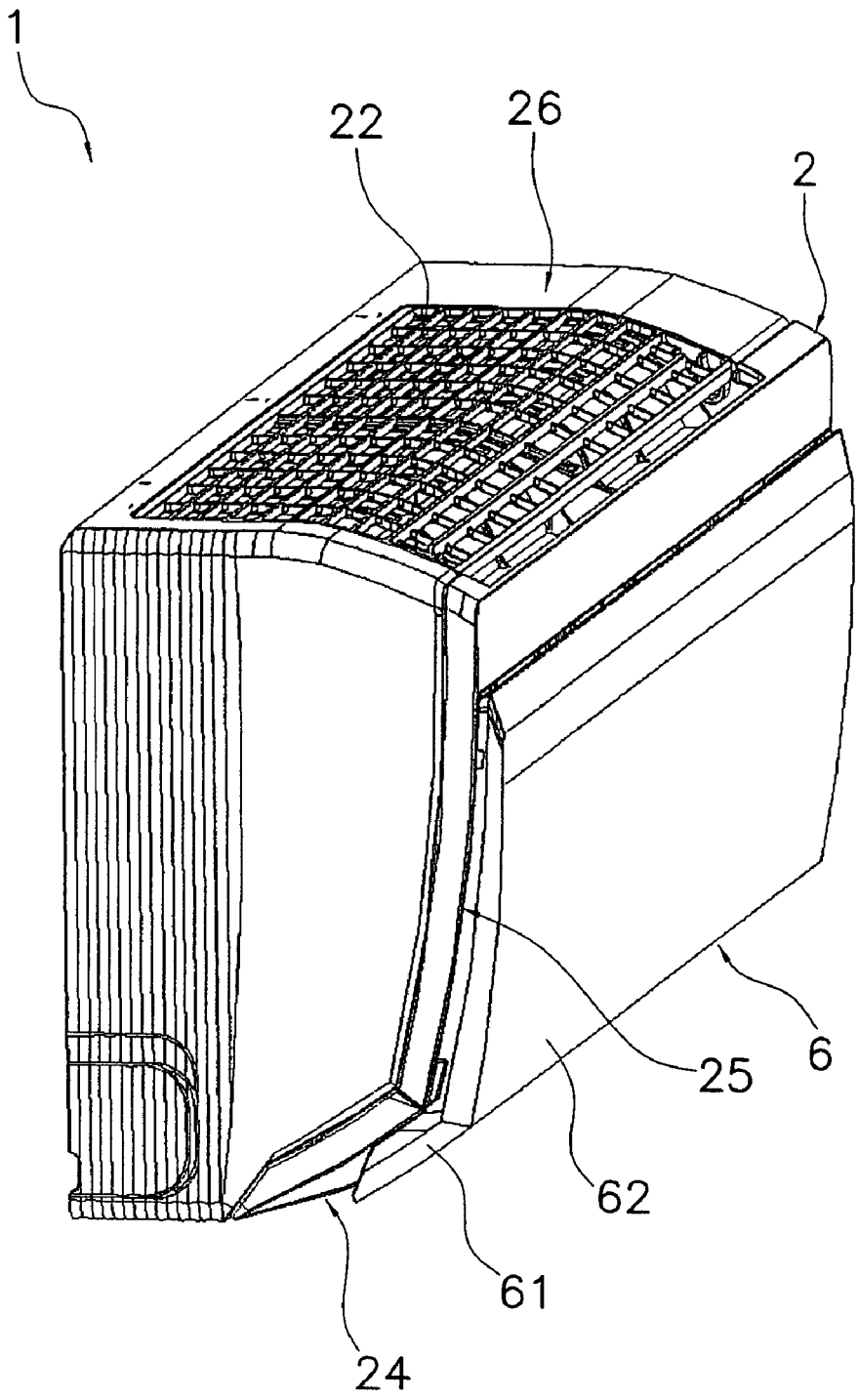
FIG. 2 is an external perspective view of the indoor unit of the air conditioner according to the embodiment of the present invention viewed from the diagonally left upper side.
Figure 3:
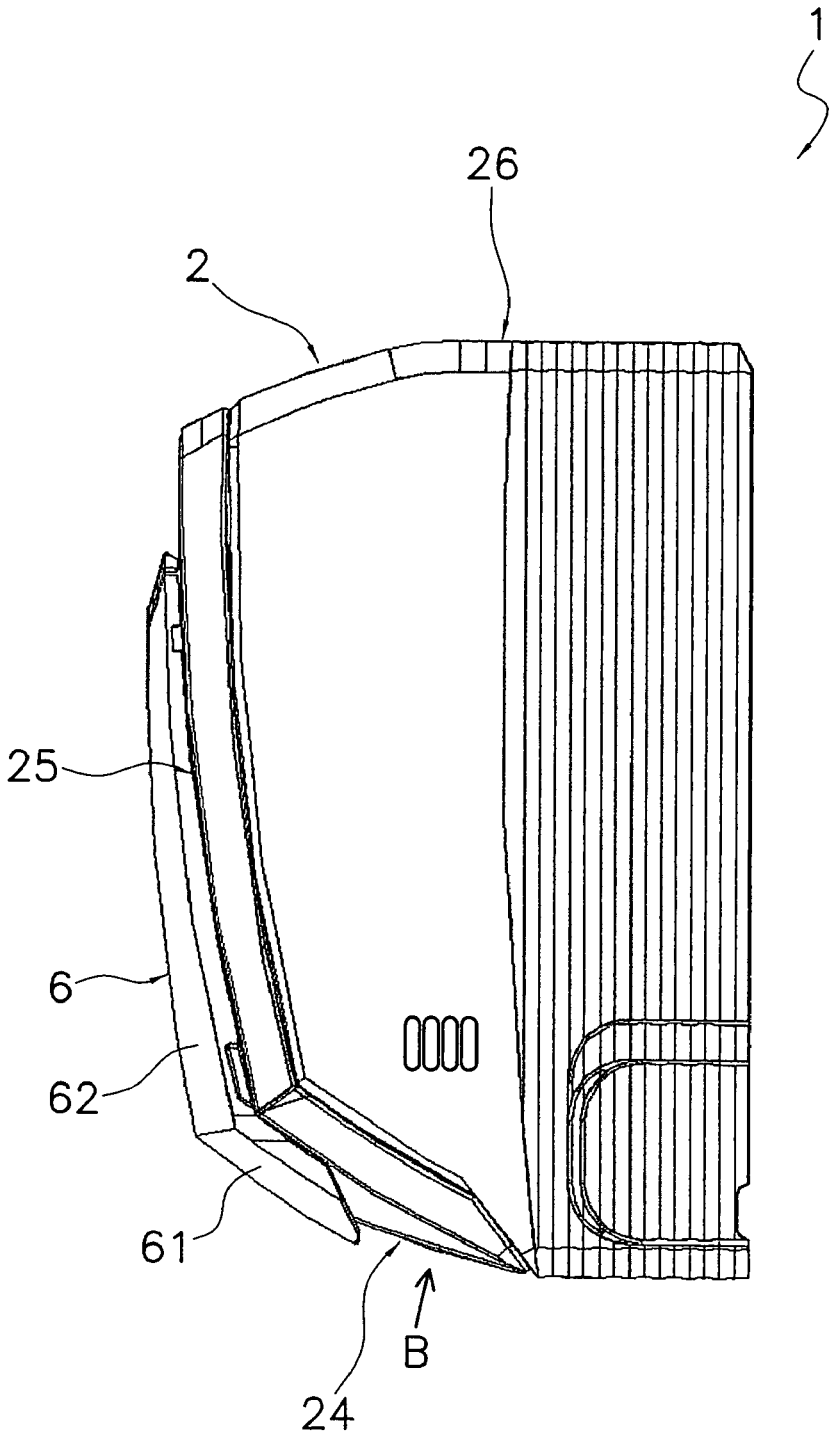
FIG. 3 is a right side view of the indoor unit of the air conditioner according to the embodiment of the present invention.

FIG. 1, FIG. 2, and FIG. 3 show an external view of an indoor unit 1 of an air conditioner according to an embodiment of the present invention. Note that in the description below, when direction and position for the indoor unit 1 are indicated, related terms are used with a state in which the indoor unit 1 is attached to a wall of a room as a reference. In addition, a side of the indoor unit 1 attached to the wall is regarded as a rear side of the indoor unit 1 (i.e., a casing 2), a side opposing the rear side and projecting into the room is regarded as a front side (or the front), lateral sides of the front side and the rear side are regarded as lateral sides (more specifically, a right side viewed from the front is regarded as a right lateral side, and a left side viewed from the front is regarded as a left lateral side), an upper side of the front side and rear side is regarded as a top side, and a lower surface of the front side and rear side is regarded as a bottom side. In addition, a horizontal plane of the indoor unit 1 indicates a plane perpendicular to the wall when the wall of the room is vertical. Here, FIG. 1 is an external perspective view of the indoor unit 1 viewed from diagonally right lower side; FIG. 2 is an external perspective view of the indoor unit 1 viewed from diagonally left upper side; and FIG. 3 is a right side view of the indoor unit 1.

This indoor unit 1 of the air conditioner is a wall-hung type indoor unit attached to the upper portion of a wall of a room and provided with a function to cool and heat the room. The indoor unit 1 mainly comprises the casing 2, a ventilation fan 3 (see FIG. 4), an indoor heat exchanger 4 (see FIG. 4), a horizontal flap 5, a front panel 6, a moving mechanism 7 (see FIG. 6), and a main body display 8.

<Casing>

Figure 4:
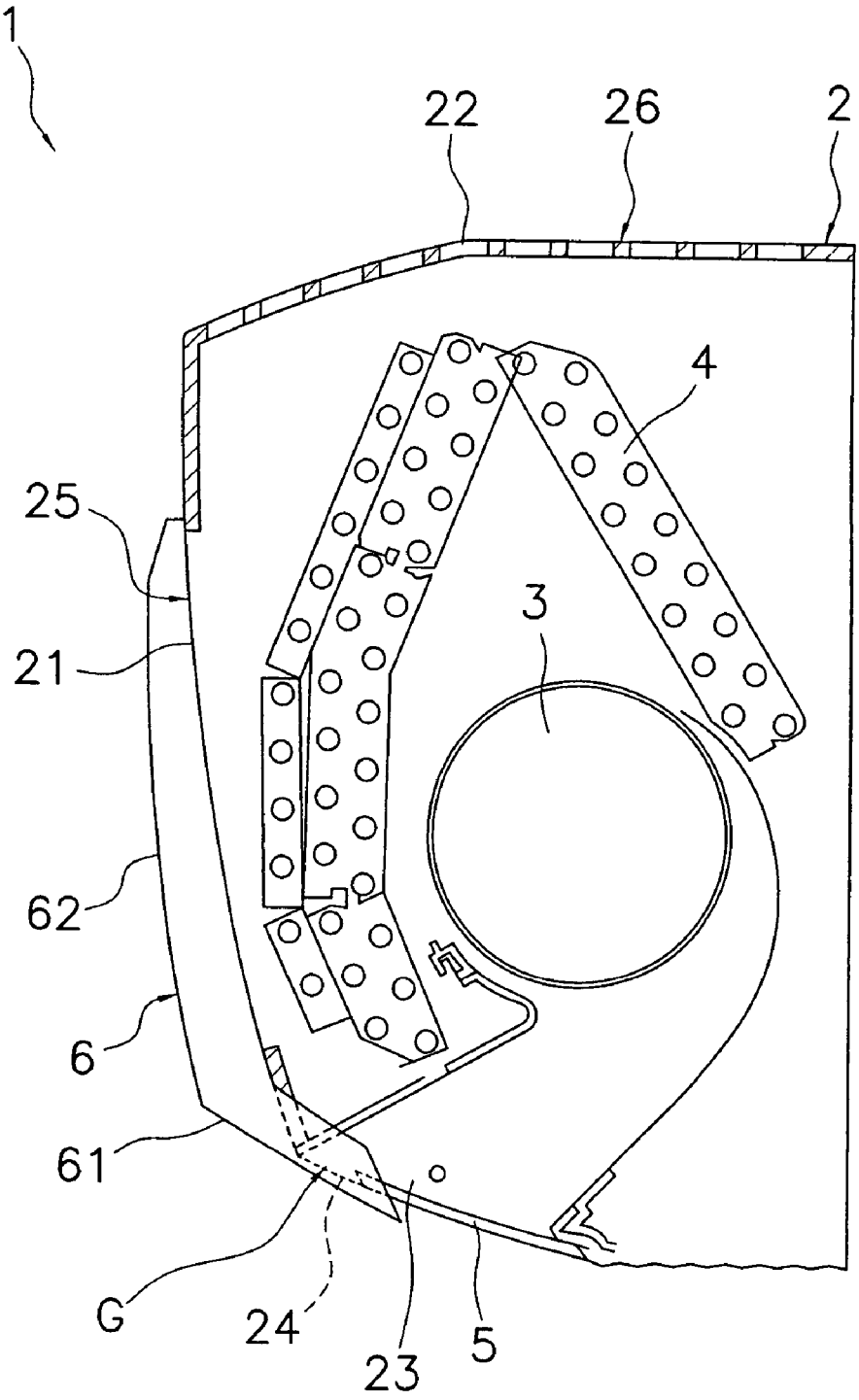
FIG. 4 is a side cross sectional view of an internal structure near the center of the indoor unit of the air conditioner in the horizontal direction according to the embodiment of the present invention.
Figure 10:
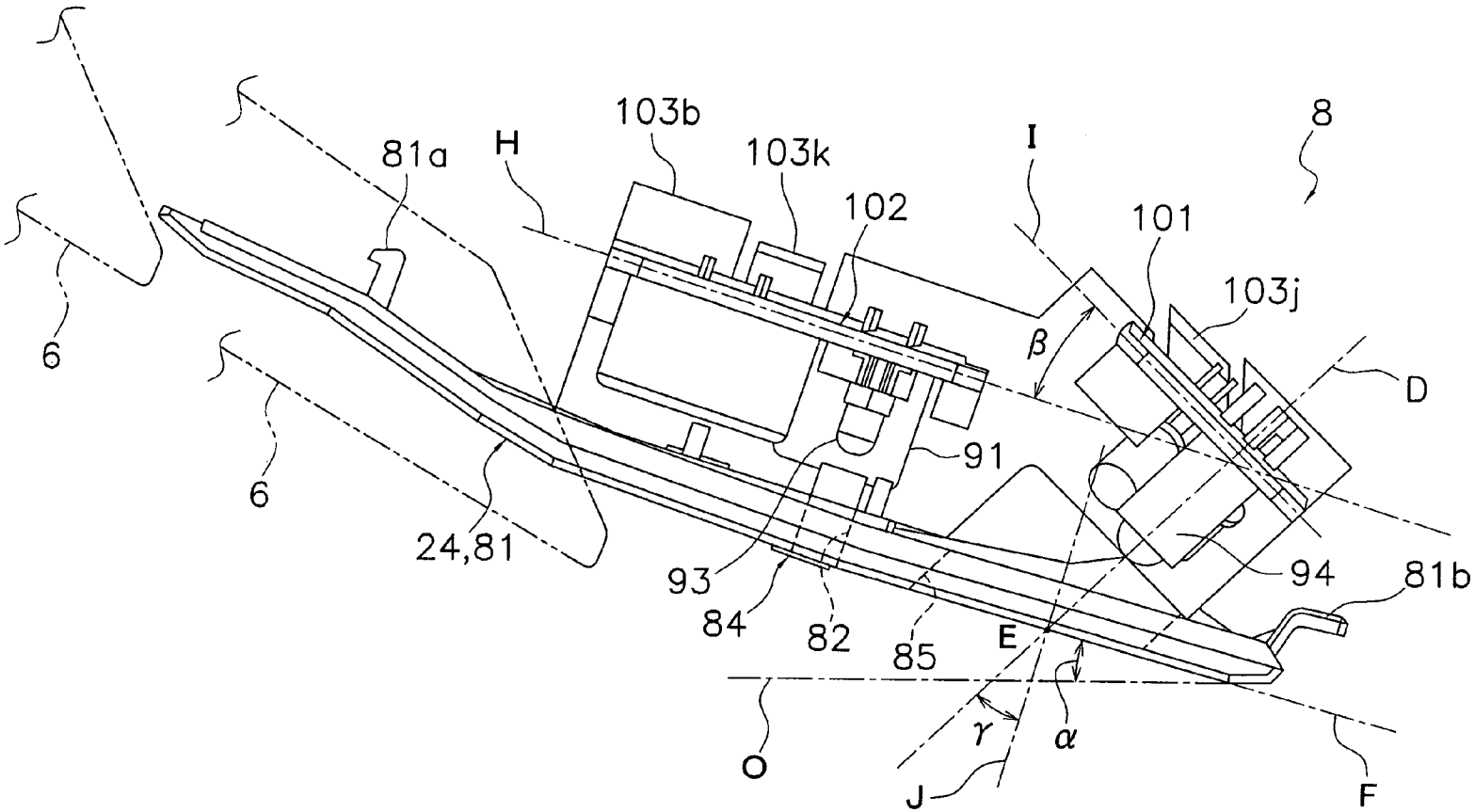
FIG. 10 is a right side view of a main body display (as for a substrate support member, only a left surface thereof is shown).

The casing 2 has a rectangular parallelepiped shape elongated in the horizontal direction when viewed from the front, and as shown in FIG. 4, the casing 2 mainly houses the ventilation fan 3, the indoor heat exchanger 4, and components of the main body display 8 (see FIG. 10). The casing 2 is provided with the front panel 6 at the front side thereof. The front panel 6 is described in detail later. The casing 2 is provided with a first air inlet 21, a second air inlet 22, and an air outlet 23. Here, FIG. 4 is a side cross sectional view of an internal structure near the center of the indoor unit 1 in the horizontal direction.

Figure 5:
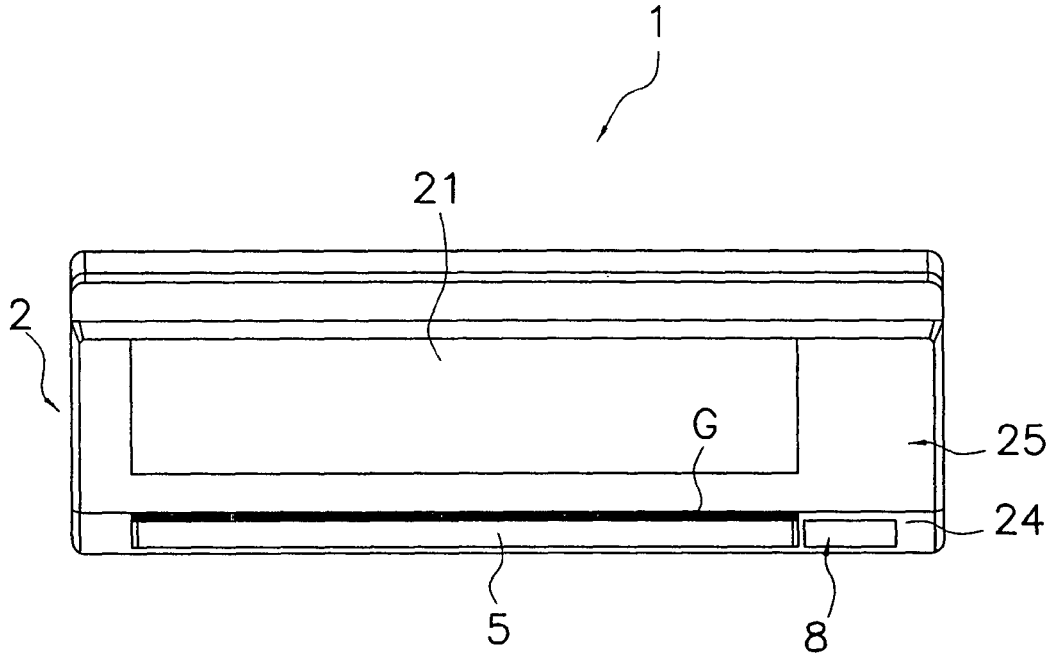
FIG. 5 is an elevation view of the indoor unit with a front panel removed.

The air outlet 23 is an opening through which air blown out from the casing 2 into the room passes, and is provided at a first casing surface 24. The first casing surface 24 forms a front portion of the bottom side of the casing 2. This first casing surface 24 is provided such that its front end is located above its lower end, in other words, the first casing surface 24 is inclined upward with respect to the horizontal plane in a state in which the casing 2 is attached to the wall. As shown in FIG. 5, the air outlet 23 is provided at the first casing surface 24 excluding both end portions thereof in the horizontal direction. In addition, the air outlet 23 is provided with the horizontal flap 5. Here, FIG. 5 is an elevation view of the indoor unit 1 with the front panel 6 removed.

The first air inlet 21 is an opening through which air is sucked into the casing 2 from the room, and is provided at a second casing surface 25. The second casing surface 25 forms the front side of the casing 2, and the first air inlet 21 is provided at the front side of the casing 2. The second casing surface 25 has a generally flat shape that extends in the up and down direction, and is inclined such that its upper end is located slightly forward than its lower end. The lower end of the second casing surface 25 is continuous with the upper end of the first casing surface 24, and the second casing surface 25 forms a predetermined angle with respect to the first casing surface 24. In other words, the first casing surface 24 and the second casing surface 25 have a curved shape and they form a relatively gentle angle between 90 degrees included and 180 degrees excluded. As is the case with the air outlet 23, the first air inlet 21 is provided at the second casing surface 25 excluding both end portions thereof in the horizontal direction.

The second air inlet 22 is an opening through which air is sucked into the casing 2 from the room, and is provided at a third casing surface 26. The third casing surface 26 forms the top side of the casing 2 and is provided with a lattice-shaped air intake grille.

<Ventilation Fan>

The ventilation fan 3 is formed in a cylindrical shape elongated in the horizontal direction. The ventilation fan 3 is a cross flow fan disposed such that the central axis thereof is parallel to the horizontal direction. The ventilation fan 3 has a plurality of blades provided at the peripheral surface thereof. The ventilation fan 3 is rotatably driven about the central axis by a fan motor (not shown), sucks indoor air into the casing 2 through the first air inlet 21 and the second air inlet 22, causes the air to pass through the indoor heat exchanger 4, and then generates a flow of the air blown out from the casing 2 into the room through the air outlet 23. The ventilation fan 3 is disposed generally at the center of the indoor unit 1 in the side view.

<Horizontal Flap>

The horizontal flap 5 is provided so as to be able to open and close the air outlet 23 and guides air blown out from the air outlet 23 to the room. The horizontal flap 5 has a plate shape elongated in the horizontal direction of the casing 2, and is provided at the air outlet 23 so as to be able to rotate about its shaft parallel to the horizontal direction of the casing 2. The horizontal flap 5 is rotatably driven by the flap motor (not shown). The horizontal flap 5 has a shape slightly smaller than the air outlet 23. As shown in FIG. 5, a gap G is provided between the upper end of the horizontal flap 5 that closes the air outlet 23 and the casing 2. Because this gap G is provided, the horizontal flap 5 is capable of rotating at the air outlet 23 without much restriction.

<Front Panel>

The front panel 6 is provided at the front side of the casing 2. The front panel 6 moves forward of the casing 2 to open the first air inlet 21, and moves closer to the casing 2 to close the first air inlet 21 (hereinafter referred to as a closed state). In this way, the front panel 6 opens and closes the first air inlet 21. In addition, the front panel 6 is provided so as to cover the front side of the casing 2 from one end to the other end (i.e., from the left end to the right end) in the closed state. More specifically, the front panel 6 covers the second casing surface 25 from the left end to the right end excluding the upper end portion, and covers the upper end portion of the first casing surface 24 from the left end to the right end. In other words, the front panel 6 extends further laterally than both end portions of the first air inlet 21 and the air outlet 23 of the casing 2 in the horizontal direction. In addition, the gap G and the upper end portion of the horizontal flap 5 are covered by the front panel 6. The front panel 6 has a shape curved along the first casing surface 24 and the second casing surface 25 of the casing 2, and includes a first panel portion 61 and a second panel portion 62.

The first panel portion 61 has a shape that extends along the first casing surface 24, and is a portion that covers the upper end of the horizontal flap 5 when the front panel 6 is in the closed state. In other words, the first panel portion 61 forms the lower portion of the front panel 6.

The second panel portion 62 has a shape that extends along the second casing surface 25, and is a portion that covers the first air inlet 21 when the front panel 6 is in the closed state. In other words, the second panel portion 62 forms the upper portion of the front panel 6.

Figure 9:
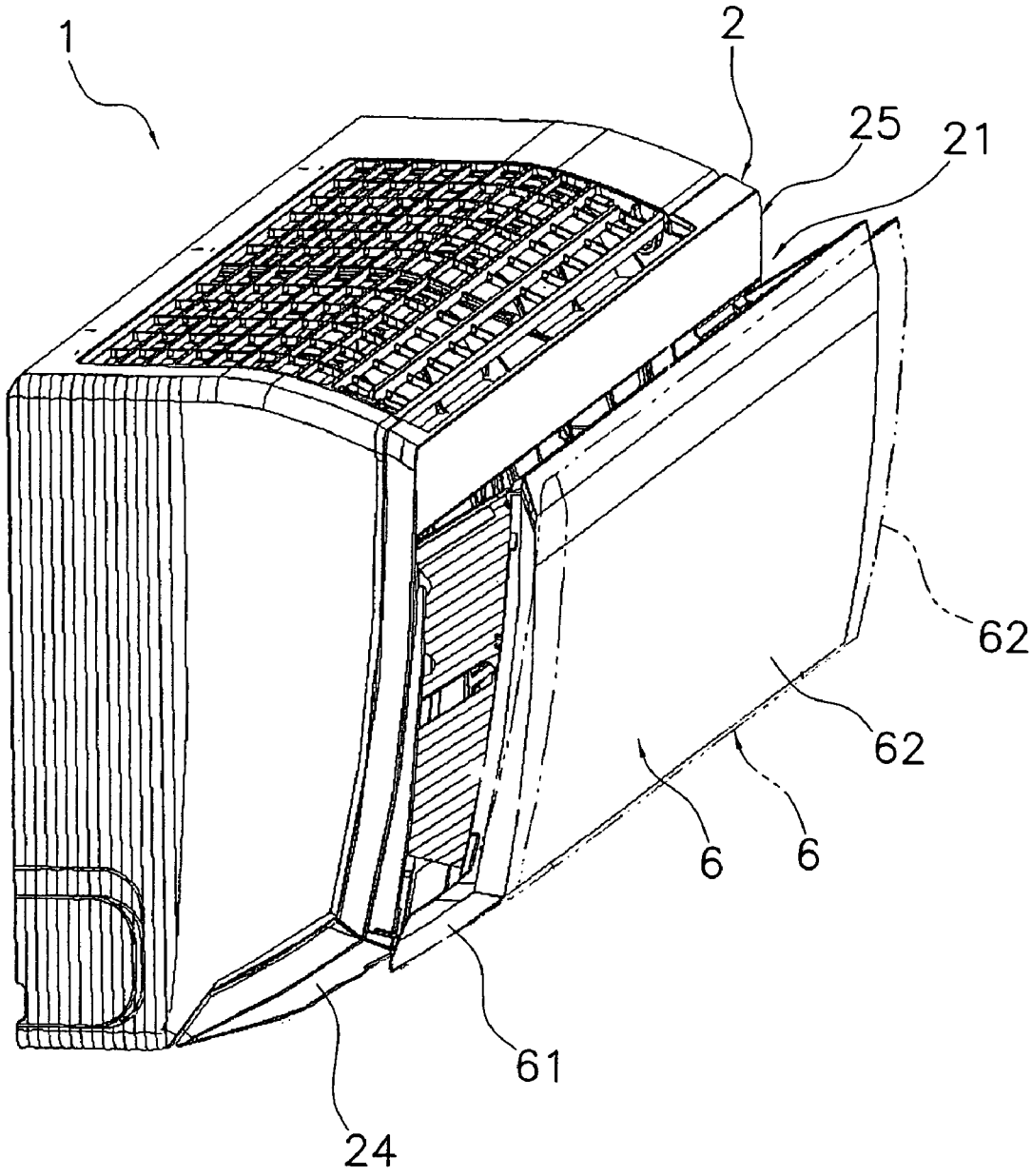
FIG. 9 is an external perspective view of the indoor unit in a first open state and a second open state, viewed from the diagonally left upper side.

Note that the front panel 6 is supported by first support members 71 at its both ends (see FIG. 9). The two first support members 71 are provided at the both ends of the casing 2, and are provided to be movable in the front and back direction. The first support members 71 move the front panel 6 in the front and back direction and enable the same to open and close the first air inlet 21.

<Moving Mechanism>

Figure 6:
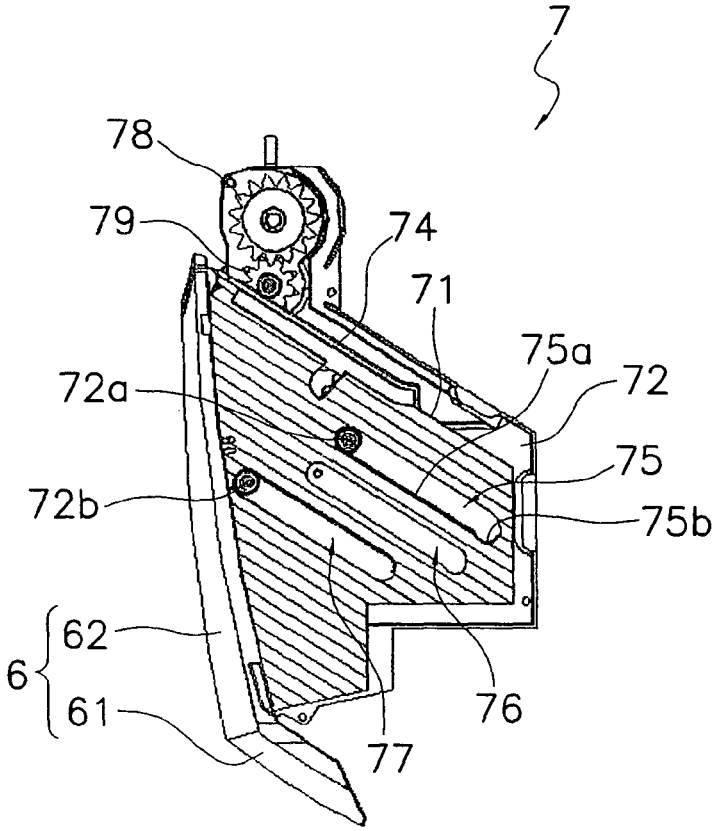
FIG. 6 is a view of a structure of a moving mechanism.
Figure 7:
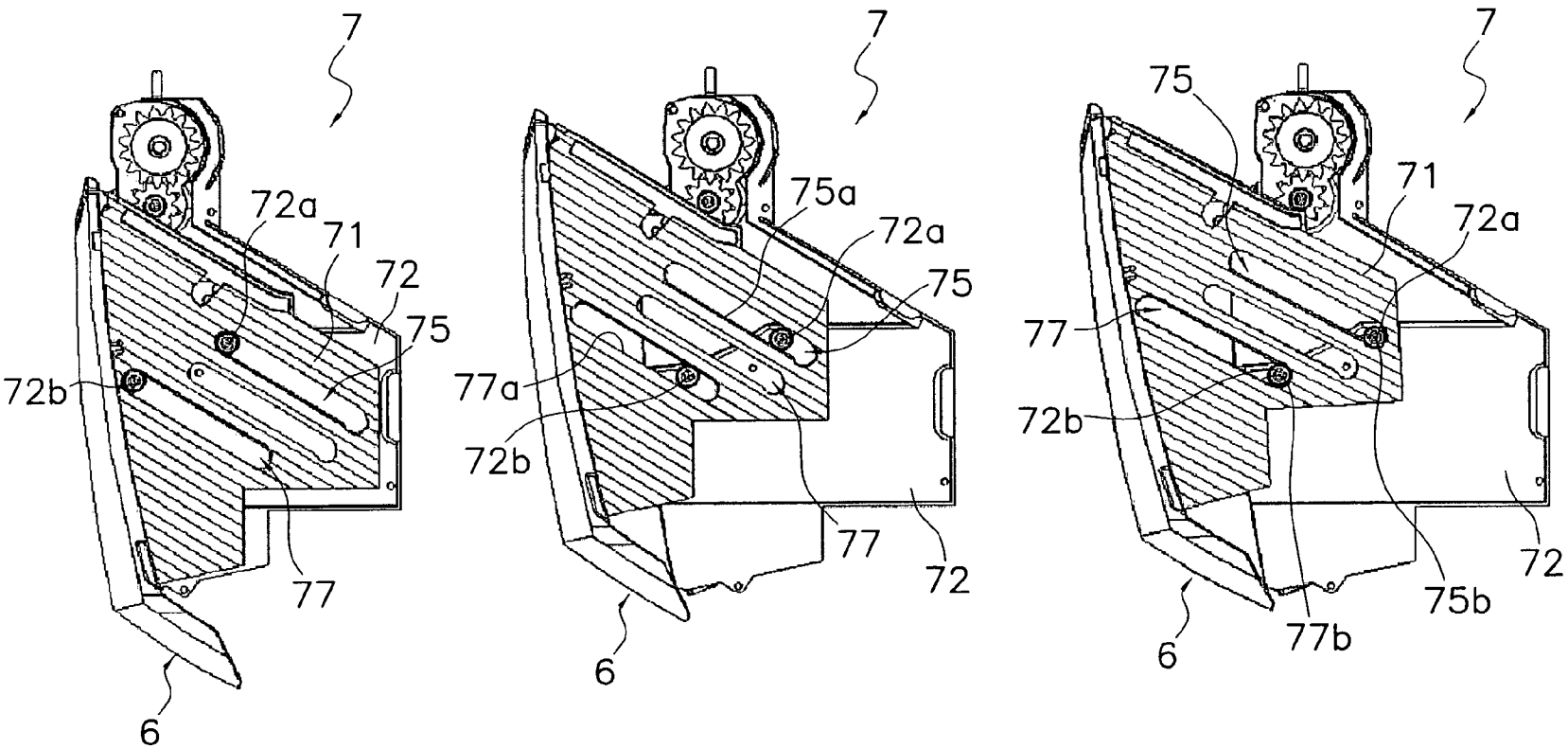
FIG. 7 is a view showing opening and closing movement of the moving mechanism.

As shown in FIG. 6 and FIG. 7, the moving mechanism 7 is a mechanism that moves the front panel 6 such that the first air inlet 21 is opened at a desired angle. The moving mechanism 7 moves the front panel 6 to achieve the following states: a closed state in which the front panel 6 closes the first air inlet 21 (the state in FIG. 7(*a*)); a state in which the front panel 6 moves forward from the closed state and opens the first air inlet 21 (the state in FIG. 7(*b*), hereinafter referred to as a first open state); and a state in which the front panel 6 moves further forward from the first open state and opens the first air inlet 21 more widely (the state in FIG. 7(*c*), hereinafter referred to as a second open state). When the front panel 6 moves from the closed state to the first open state, the front panel 6 moves forward along the first casing surface 24, and when the front panel 6 moves from the first open state to the second open state, the front panel 6 rotationally moves such that its upper end portion opens forward. When the front panel 6 is in the first open state, the first air inlet 21 is opened at a first angle. In addition, when the front panel 6 is in the second open state, the first air inlet 21 is opened at a second angle, which is largest angle larger than the first angle. The moving mechanism 7 mainly includes the first support members 71, second support members 72, and a panel drive motor (not shown). Here, FIG. 6 is a view of a structure of the moving mechanism 7, and FIG. 7 is a view showing opening and closing movement of the moving mechanism 7.

The first support members 71 are plate shaped members that support the left side end and the right side end of the front panel 6 and extend in a generally vertical direction and in a forward direction. An upper end edge of each first support member 71 is inclined downwardly in a direction from its front portion to its rear portion. Further, a rack gear 74 engaged with a later described second pinion gear 79 is provided along the upper end edge of each first support member 71. In addition, a first slit portion 75, a second slit portion 76, and a third slit portion 77 are provided at the center portion of each first support member 71 in the up and down direction. Each of the slit portions 75, 76, 77 is a long hole penetrating through the both sides of each first support member 71, and as is the case with the first support members 71, each is inclined downwardly in a direction from its front portion to its rear portion. In this embodiment, the first slit portion 75 is inclined so as to extend along the first panel portion 61, in other words, so as to extend along the first casing surface 24. The first slit portion 75 includes a straight portion 75*a* linearly extending from the rear lower position to the front upper position, and a curve portion 75*b* that is continuous with the rear end of the straight portion 75*a* and slightly concavely curved downwardly. As is the case with the first slit portion 75, each of the second slit portion 76 and the third slit portion 77 includes a straight portion and a curve portion. Note that the second slit portion 76 is located below the first slit portion 75, and the third slit portion 77 is located below the second slit portion 76. In addition, the first slit portion 75, the second slit portion 76, and the third slit portion 77 are disposed mutually parallel.

The second support members 72 are members configured to support the first support members 71 such that the first support members 71 are capable of linearly moving and rotationally moving in the front and back direction of the casing 2. The second support members 72 are attached to the inner surface of the right lateral side and the inner surface of the left lateral side of the casing 2. Each of the second support members 72 has a first pinion gear 78 and the second pinion gear 79 that are engaged with each other. The first pinion gear 78 is rotationally driven by the panel drive motor (not shown) and transmits the rotation to the second pinion gear 79. The second pinion gear 79 transmits the rotation transmitted from the first pinion gear 78 to the rack gear 74. In addition, a first support claw 72*a* and a second support claw 72*b* are provided in the vicinity of the center of each second support member 72. The first support claw 72*a* has a cylindrical shape laterally projecting from the front surface of each second support member 72, and is inserted to the first slit portion 75 of each first support member 71. The first support claw 72*a* is engaged with the first slit portion 75 and supports each first support member 71. As is the case with the first support claw 72*a*, the second support claw 72*b* has a cylindrical shape projecting from the front surface of each second support member 72, and is inserted to the third slit portion 77 of the first support members 71. The second support claw 72*b* is engaged with the third slit portion 77 and supports each first support member 71. When the front panel 6 performs opening and closing movement, the first support claw 72*a* and the second support claw 72*b* slide with respect to the first slit portion 75 and the second slit portion 76, respectively, and thereby support the front panel 6 that moves in the front and back direction.

(2) OPENING AND CLOSING MOVEMENT OF THE FRONT PANEL

Figure 8:
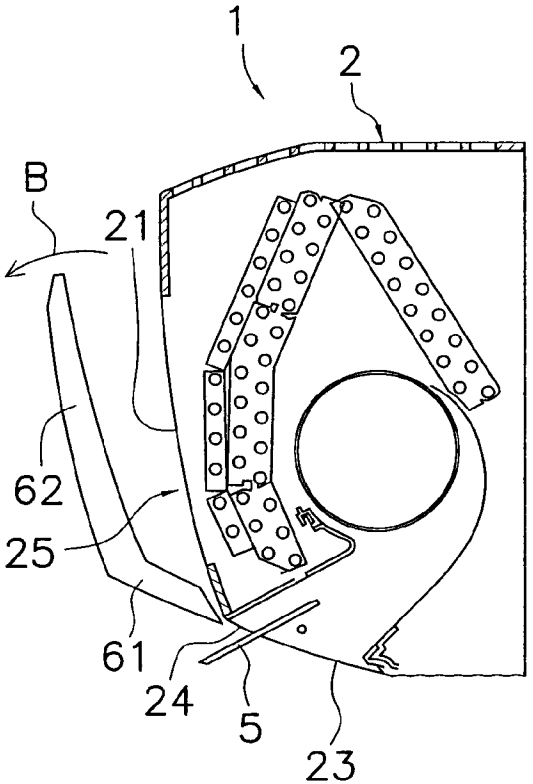
FIG. 8 is a view showing opening and closing movement of the front panel.
Figure 8:
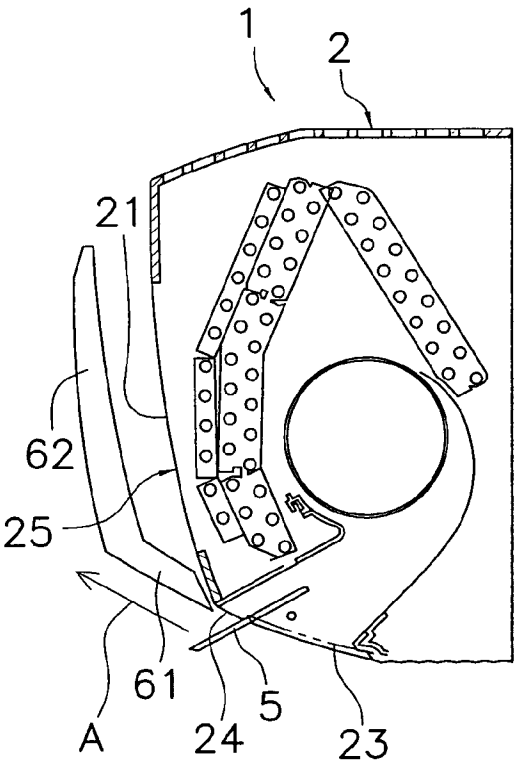
Figure 8:
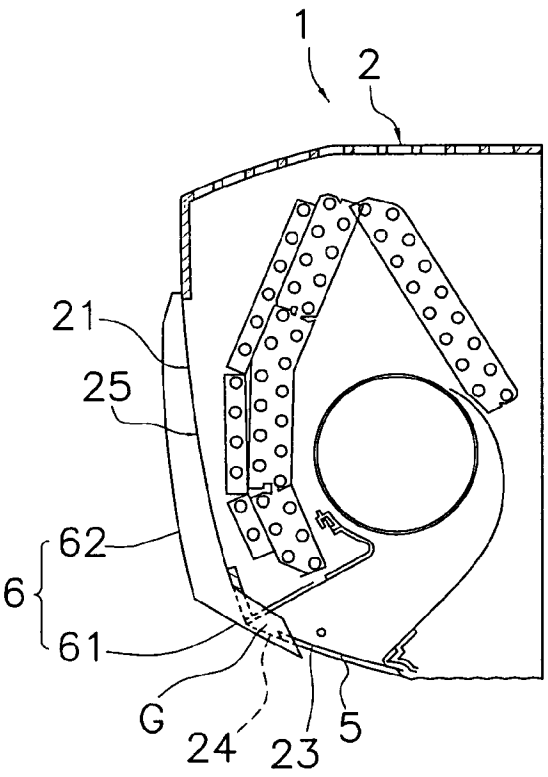

Next, opening and closing movement of the front panel 6 is described with reference to FIG. 2, FIG. 7, FIG. 8, and FIG. 9. Here, FIG. 8 is a view showing opening and closing movement of the front panel 6, and FIG. 9 is an external perspective view of the indoor unit 1 in the first open state and the second open state, viewed from the diagonally left upper side.

When the operation of the indoor unit 1 of the air conditioner is stopped, the horizontal flap 5 closes the air outlet 23 and the front panel 6 is in the closed state. In the closed state, as shown in FIG. 7(*a*), the front end of the first slit portion 75 of the first support members 71 is close to the first support claw 72*a*, and the front end of the third slit portion 77 of the first support members 71 is close to the second support claw 72*b*, and as shown in FIG. 8(*a*), the front panel 6 is in a state of covering the first air inlet 21 and also the upper end of the horizontal flap 5. In this closed state, the first panel portion 61 covers the upper portion of the first casing surface 24 including the upper end portion of the horizontal flap 5 and the upper portion of the gap G and the air outlet 23. In addition, the second panel portion 62 covers the second casing surface 25. In the closed state, the front panel 6 is in a state of being close to the first casing surface 24 and the second casing surface 25 along the first casing surface 24 and the second casing surface 25. Accordingly, when the operation of the indoor unit 1 is stopped, a portion from the upper end of the horizontal flap 5 to the first air inlet 21 is covered from the outside.

When the front panel 6 moves from the closed state to the first open state, as shown in FIG. 7(*b*), the first support members 71 moves such that the rear end of the straight portion 75*a* of the first slit portion 75 is close to the first support claw 72*a* and the rear end of a straight portion 77*a* of the third slit portion 77 is close to the second support claw 72*b*. At this time, the straight portion 75*a* of the first slit portion 75 slides with respect to the first support claw 72*a*, and the straight portion 77*a* of the third slit portion 77 slides with respect to the second support claw 72*b*. Accordingly, the first support members 71 move diagonally forward-upward, and as shown in FIG. 8(*b*), the front panel 6 moves diagonally forward-upward in parallel along the first casing surface 24 (see arrow A in FIG. 8). At this time, the first panel portion 61 moves diagonally forward-upward along the first casing surface 24, and the second panel portion 62 moves diagonally forward-upward so as to be away from the second casing surface 25, and consequently the front panel 6 opens the air outlet 23 and the first air inlet 21. Then, the first panel portion 61 moves to a position where its lower end is above the upper end of the air outlet 23 so as to prevent the first panel portion 61 from blocking air blowing out from the air outlet 23, and the first panel portion 61 also covers the lower portion of the space between the second panel portion 62 and the second casing surface 25. Then, the horizontal flap 5 that has closed the air outlet 23 rotates and thereby the air outlet 23 is opened. In addition, in this state, as shown in FIG. 9, the upper portion of the space between the second panel portion 62 and the second casing surface 25 is opened, enabling air sucked into the casing 2 from the first air inlet 21 to pass therethrough (see the front panel 6 shown by a solid line in FIG. 9). Note that, in the first open state, both side portions between the second panel portion 62 and the second casing surface 25 are covered by the first support members 71, and the first support members 71 serve as blind to prevent the inside of the casing 2 from being seen from the outside through the first air inlet 21.

Further, when the front panel 6 moves from the first open state to the second open state, as shown in FIG. 7(*c*), each of first support members 71 move such that the curve portion 75*b* of the first slit portion 75 is engaged with the first support claw 72*a*, and a curve portion 77*b* of the third slit portion 77 is engaged with the second support claw 72*b*. Accordingly, the first support members 71 rotationally move, and as shown in FIG. 8(*c*), the front panel 6 rotationally moves such that its upper end falls forward (see arrow B). At this time, the lower end of the first panel portion 61 is still at a position in the first open state, and as the front panel 6 rotates about the lower end of the first panel portion 61, the upper end of the second panel portion 62 rotationally moves forward. Accordingly, the upper portion between the second panel portion 62 and the second casing surface 25 is further opened, and the first air inlet 21 is more widely opened (see the front panel 6 shown by a two-dot chain line in FIG. 9).

Note that, when the front panel 6 moves from the second open state to the first open state, the front panel 6 rotationally moves in the opposite direction described above. In addition, when the operation of the indoor unit 1 is stopped, the horizontal flap 5 turns and closes the air outlet 23, and subsequently the front panel 6 moves in a manner opposite to the above, and the portion from the upper end of the horizontal flap 5 to the first air inlet 21 is again covered from the outside.

(3) STRUCTURE OF THE MAIN BODY DISPLAY

As described above, the indoor unit 1 of the air conditioner in this embodiment has a structure in which, when the operation is stopped, the portion from the upper end of the horizontal flap 5 to the first air inlet 21 is covered by the front panel 6. Accordingly, the gap G relatively large in size for enabling the horizontal flap 5 to be rotatable is difficult to be seen from the outside. In addition, although the first air inlet 21 and the air outlet 23 are formed only at the portion of the front side of the casing 2 excluding its both end portions in the horizontal direction, the front panel 6 is provided so as to cover the front side of the casing 2 from the left end to the right end. Accordingly, with this indoor unit 1, interior quality is improved and thus the aesthetic appearance is enhanced.

However, in this embodiment, since this front panel 6 covers most part of the front side of the casing 2, the main body display 8 has to be disposed at the bottom side of the casing 2 or in the vicinity thereof. Specifically, the main body display 8 is disposed at the first casing surface 24 as the first surface. In this embodiment, the first casing surface 24 is inclined upward toward the front such that the angle with respect to the horizontal plane O is 30 degrees or less. Here, given that the angle formed by the first casing surface 24 and the horizontal plane O is an angle $\alpha$, the angle $\alpha$ is an angle formed by the horizontal plane O and the tangent plane at each portion of the first casing surface 24, in consideration of that the first casing surface 24 is a surface that is not completely flat but slightly curved. For example, given that the tangent plane at a point E where a centerline D of a later described receiving element 94 intersects with an outer surface of the first casing surface 24 is a tangent plane F, and an angle formed by this tangent plane F and the horizontal plane O corresponds to the angle $\alpha$. The angle $\alpha$ at each portion of the first casing surface 24 is 30 degrees or less. In FIG. 10, the angle $\alpha$ is 20 degrees or less.

Figure 11:
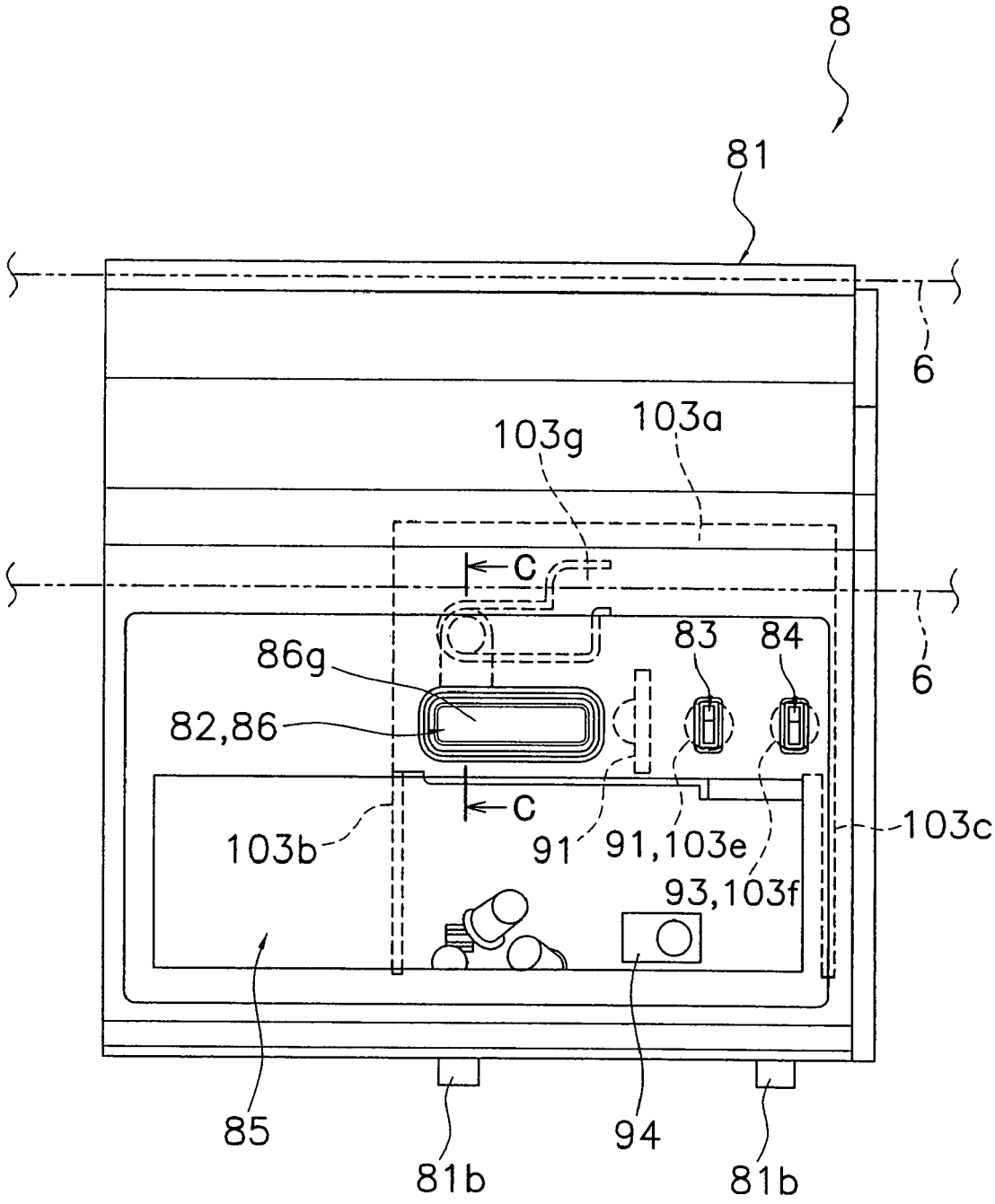
FIG. 11 is a view of the main body display, viewed from the direction of arrow B of FIG. 3.

Next, the main body display 8 in this embodiment is described with reference to FIG. 1, FIG. 10, and FIG. 11. Here, FIG. 10 is a right side view of the main body display 8 (as for a substrate support member 103, only a left side portion 103*b* is shown), and FIG. 11 is a view of the main body display 8, viewed from the direction of arrow B of FIG. 3.

In this embodiment, the main body display 8 is disposed to the right side of the air outlet 23 of the first casing surface 24. The main body display 8 mainly includes a display panel 81.

Figure 12:
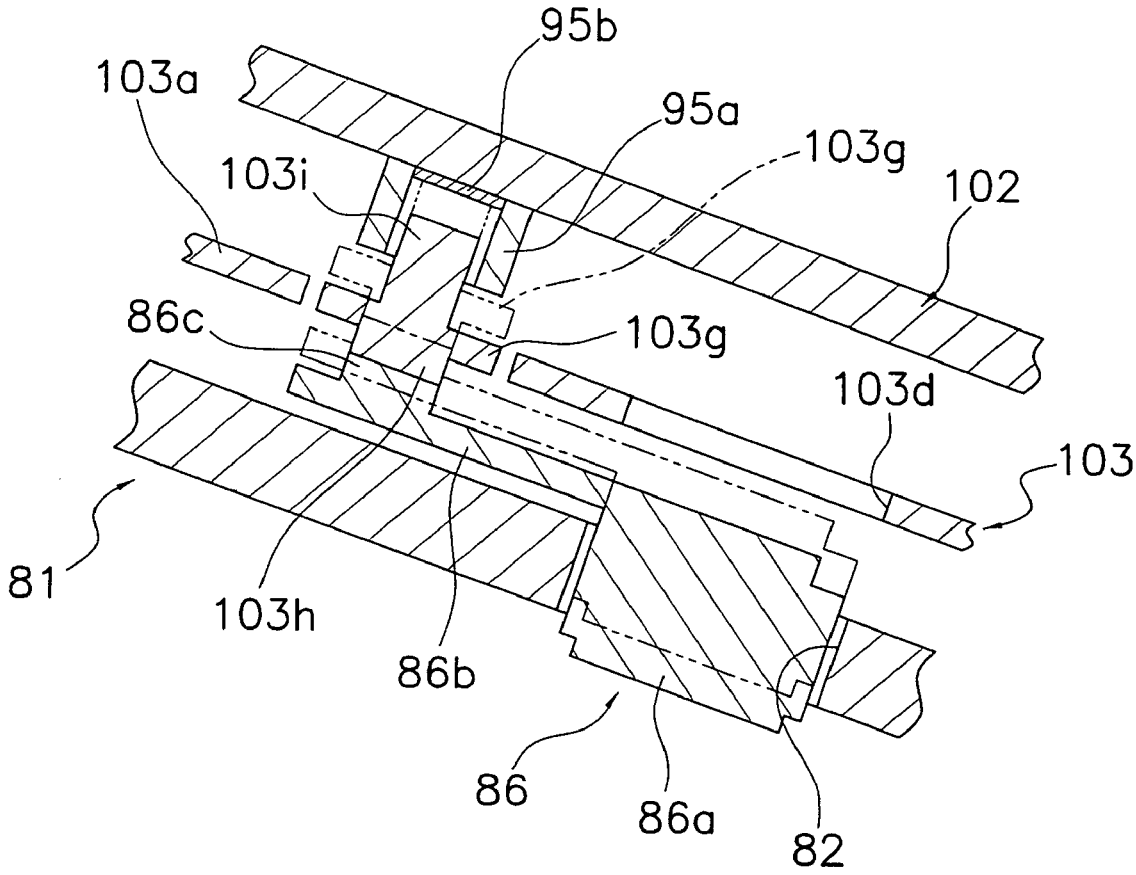
FIG. 12 is a cross sectional view taken along line C-C of FIG. 11.

The display panel 81 is a plate member having a generally quadrangular shape including a plurality of locking claws 81*a*, 81*b* at its front end and rear end. The display panel 81 is attached to a rectangular shaped opening formed to the right of the air outlet 23 of the first casing surface 24 by the locking claws 81*a*, 81*b*, and is integrated with the first casing surface 24. Included in the display panel 81 are display windows 82, 83, 84 in the vicinity of the center in the front and back direction (i.e., in the up and down direction) of the display panel 81, for visually recognizing the display of LEDs 91, 92, 93 (to be described later), and a reception window 85 behind the display windows 82 to 84, for transmitting a signal to be received by the infrared receiving element 94 (to be described later). Each of these windows 82 to 85 is provided with a resin member having translucency. In addition, the resin member provided at the display window 82 is configured to function as a start/stop button 86 used for performing the operation in the case where the remote controller is lost and the like. As shown in FIG. 12, this start/stop button 86 is provided so as to be capable of moving inside the display window 82 in the thickness direction of the display panel 81. The start/stop button 86 includes a button main body 86*a*, a tongue portion 86*b*, and a projecting portion 86*c*. The button main body 86*a* is a horizontally long portion having a generally rectangular shape inserted in the display window 82, and the button main body 86*a* slightly projects to the inside and outside of the display window 82. The tongue portion 86*b* is integrally formed with the button main body 86*a* at a portion where the button main body 86*a* projects to the inside of the display window 82. The tongue portion 86*b* is a plate shaped portion that extends forward along the inner surface of the display panel 81. The projecting portion 86*c* is a column-shaped portion provided at the front end of the tongue portion 86*b* and extends to the inside of the casing 2. In addition, the lower end of the front panel 6 extends to a position where it does not cover the display windows 82 to 84 of the display panel 81 in the closed state (see the lower end of the front panel 6 shown by a two-dot chain line in the vicinity of the display windows 82 to 84 in FIG. 10 and FIG. 11), and the lower end of the front panel 6 extends to a position where it slightly covers the front end of the display panel 81 in the first and second open states (see the lower end of the front panel 6 shown by a two-dot chain line in the vicinity of the front end of the display panel 81 in FIG. 10 and FIG. 11). Here, FIG. 12 is a cross sectional view taken along line C-C of FIG. 11.

Inside the display panel 81, there are provided a first substrate 101 and a second substrate 102 so as to face the inner surface of the first casing surface 24. The first substrate 101 and the second substrate 102 are supported by the substrate support member 103 disposed so as to correspond to portions where the windows 82 to 85 of the display panel 81 are provided.

The substrate support member 103 is supported by the casing 2, and mainly includes a lower side portion 103*a* having a rectangular shape and disposed between the display panel 81 and the second substrate 102, and the left side portion 103*b* and a right side portion 103*c* which extend from the both ends of the lower side portion 103*a* so as to laterally sandwich the first substrate 101 and the second substrate 102. The lower side portion 103*a* is provided with penetrating holes 103*d*, 103*e*, 103*f* formed so as to correspond to the display windows 82 to 84, and an elastic portion 103*g* formed at a position forward of the penetrating hole 103*d*. The elastic portion 103*g* is a belt-like portion in which an end provided at the lower side portion 103*a* is capable of elastically changing its shape in the thickness direction of the lower side portion 103*a*. The end portion of the elastic portion 103*g* is disposed so as to correspond to the projecting portion 86*c* of the start/stop button 86. The end portion of the elastic portion 103*g* is provided with a first projecting portion 103*h* having a column-shape which is in contact with a leading edge of the projecting portion 86*c*, and a second projecting portion 103*i* having a column-shape which is formed on a side opposite the side on which the first projecting portion 103*h* is formed. Each of the left side portion 103*b* and the right side portion 103*c* has a support claw 103*j* formed thereon for supporting the first substrate 101. In addition, each of the left side portion 103*b* and the right side portion 103*c* has a support claw 103*k* formed thereon for supporting the second substrate 102.

The second substrate 102 is disposed such that its substrate surface H is generally parallel to the display panel 81 (i.e., the first casing surface 24). On the other hand, the first substrate 101 is disposed such that its substrate surface I is inclined more upward, compared to the display panel 81 (i.e., the first casing surface 24). In other words, the first substrate 101 is disposed so as to be inclined forward with respect to the plane perpendicular to the first casing surface 24. In other words, the first substrate 101 is disposed so as to be inclined upward in the forward direction by an angle β with respect to the second substrate 102.

On the second substrate 102, LEDs 91, 92, 93 are mounted as indicating devices to display the operating state of the air conditioner, and a switch 95 is mounted as an operating device to be operated via the start/stop button 86, which is used for performing the operation in the case where the remote controller is lost and the like. The LEDs 92, 93 are disposed at positions that correspond to the penetrating holes 103*e*, 103*f*, respectively, and the light thereof can be directly visually recognized through the display windows 83, 84. The LED 91 is disposed to the side of the penetrating hole 103*d*, and the light diffused through the penetrating hole 103*d* can be visually recognized indirectly through the display window 82 (i.e., the start/stop button 86). The switch 95 mainly includes a cylindrical portion 95*a* into which the second projecting portion 103*i* of the substrate support member 103 is inserted, and a switch main body 95*b* provided in the cylindrical portion 95*a*. When the start/stop button 86 is pressed, the second projecting portion 103*i* of the substrate support member 103 comes into contact with the switch main body 95*b*, and the indoor unit 1 can be operated and stopped without using the remote controller (see the elastic portion 103*g* shown by a two-dot chain line in FIG. 12).

On the first substrate 101, the infrared receiving element 94 is mounted as a receiving device to receive a signal transmitted from the remote controller. This receiving element 94 is disposed at a position that corresponds to the reception window 85. More specifically, the receiving element 94 is disposed at a position behind the reception window 85. In addition, the receiving element 94 is disposed behind the LEDs 91, 92, 93. Further, the receiving element 94 is configured such that its lower end is disposed more rearward than the lower end of the front panel 6.

Further, the receiving element 94 is disposed such that the centerline D of the receiving element 94 is inclined with respect to an orthogonal plane J perpendicular to the tangent plane F (i.e., a tangent plane at a point E that is a point intersecting with the outer surface of the display panel 81) and is also directed diagonally downward. Specifically, the centerline D is inclined by an angle γ with respect to the orthogonal plane J.

(4) CHARACTERISTICS OF THE INDOOR UNIT OF THE AIR CONDITIONER

The indoor unit 1 of the air conditioner in this embodiment has the following characteristics.

(A)

The indoor unit 1 of the air conditioner in this embodiment further comprises the front panel 6 which is disposed so as to cover the front side of the casing 2 from one end to the other end and which moves forward of the casing 2 during operation in order to open the first air inlet 21. Therefore, the receiving element 94 as a receiving device has to be disposed at the lower portion of the casing 2, and also, the receiving element 94 has to be provided facing the first casing surface 24 as the first surface inclined upward so as to form an angle α of 30 degrees or less with respect to the horizontal plane O.

However, with the indoor unit 1 in this embodiment, the centerline D of the receiving element 94 is disposed so as to be inclined by the angle γ with respect to the orthogonal plane J that is a plane perpendicular to the first casing surface 24 and also so as to be directed diagonally downward. Therefore, the centerline D of the receiving element 94 is directed in the forward direction of the casing 2. Accordingly, even when the receiving element 94 has to be disposed at the first casing surface 24 (in other words at the bottom side of the casing 2 or in the vicinity thereof) whose angle with respect to the horizontal plane O is small, the receiving element 94 is capable of reliably receiving a signal transmitted from the remote controller.

In particular, it is effective when, as is the case with the indoor unit 1 in this embodiment, each of the bottom side of the casing 2 and the surface in the vicinity thereof (i.e., the first casing surface 24) forms the angle α of 20 degrees or less with respect to the horizontal plane O, since it is highly possible that a reception distance of the receiving element 94 cannot be secured in such a case.

(B)

With the indoor unit 1 of the air conditioner in this embodiment, by disposing the receiving element 94 behind the LEDs 91, 92, 93 as the indicating devices, in other words, by disposing the LEDs 91, 92, 93 and the display windows 82, 83, 84 in front of the receiving element 94, the centerline D of the receiving element 94 can be directed in the forward direction of the casing 2 while securing the visibility of the LEDs 91, 92, 93.

In particular, with the indoor unit 1 in this embodiment, the lower end of the front panel 6 extends to the vicinity of the LEDs 91, 92, 93, and the lower end of the receiving element 94 is disposed behind the lower end of the front panel 6. Therefore, the distance in a front-back direction between the lower end of the front panel 6 and the lower end of the receiving element 94 can be increased. Accordingly, it is possible to have the receiving element 94 be directed further forward of the casing 2 (specifically, the angle β formed by the first substrate 101 and the second substrate 102 is increased), and thus a signal transmitted from the remote controller can be reliably received.

(C)

With the indoor unit 1 of the air conditioner in this embodiment, the receiving element 94 and the LEDs 91, 92, 93 are mounted on the different substrates (specifically, the first substrate 101 and the second substrate 102, respectively), and flexibility in installation of the substrates 101, 102 increases. Therefore, it is easy to dispose the receiving element 94 such that the centerline D of the receiving element 94 is inclined with respect to the orthogonal plane J perpendicular to the first casing surface 24 and is also directed diagonally downward.

In addition, with the indoor unit 1 in this embodiment, the first substrate 101 is disposed so as to be inclined with respect to the second substrate 102 by the angle β, and therefore the receiving element 94 can be disposed such that the centerline D of the receiving element 94 is inclined to the orthogonal plane J and is also directed diagonally downward, without changing the shape of the receiving element 94.

(D)

With the indoor unit 1 of the air conditioner in this embodiment, the switch 95 as the operating device for performing the operation is further mounted on the second substrate 102, and thus the layout space of the switch 95 and the LEDs 91, 92, 93 can be reduced.

In particular, with the indoor unit 1 in this embodiment, the display window 82 of the LED 91 is also used as the start/stop button 86 for performing ON/OFF operation of the switch 95 (in other words, these components are integrated), and thus the layout space can be further reduced and also the design is improved.

(5) OTHER EMBODIMENT

While the selected embodiments of the present invention have been described with reference to the drawings, the scope of the invention is not limited to the above-described embodiment, and various changes and modifications can be made herein without departing from the scope of the invention.

INDUSTRIAL APPLICABILITY

Application of the present invention to a wall-hung type indoor unit of an air conditioner enables a signal transmitted from a remote controller to be reliably received by a receiving device even when the receiving device has to be disposed at the bottom side of the indoor unit or in the vicinity thereof because of the configuration of the indoor unit.

What is claimed is:

1. A wall-hung type indoor unit of an air conditioner, comprising:

a casing configured to be attached to a wall of a room and having an air inlet for indoor air at a front side thereof; and a receiving device provided at a lower portion of the casing and configured to receive a signal transmitted from a remote controller, the receiving device being mounted on a first substrate disposed within the casing, the casing having a first surface facing the receiving device, the first surface being inclined upward so as to form an angle of 30 degrees or less with respect to a horizontal plane disposed at a lower end of the first surface in a state in which the casing is attached to the wall, the receiving device being disposed such that a longitudinal centerline of the receiving device is inclined forward with respect to an inclined plane, the inclined plane being perpendicular to the first surface and intersecting the longitudinal centerline at the first surface, the longitudinal centerline of the receiving device being perpendicularly arranged relative to the first substrate and being directed diagonally downward with a lower end of the longitudinal centerline being located farther from the wall of the room than an upper end of the longitudinal centerline, the inclined plane intersecting the horizontal plane to define four quadrants, and the longitudinal centerline of the receiving device being inclined forward with respect to the inclined plane such that the receiving device is only disposed in an upper one of the four quadrants closest to the wall in the state in which the casing is attached to the wall.

2. The indoor unit according to claim 1, further comprising a front panel provided so as to cover the front side of the casing from one lateral end to the another lateral end when an operation is stopped and configured to open the air inlet when the whole front panel from an upper end to a lower end moves forward of the casing during operation.

3. The indoor unit according to claim 2, further comprising an indicating device disposed in a vicinity of the receiving device and configured to display an operating state, the receiving device being disposed behind the indicating device, a lower end of the front panel extending toward a vicinity of the indicating device, and a lower end of the receiving device being disposed behind the lower end of the front panel.

4. The indoor unit according to claim 3, wherein the indicating device is mounted on a second substrate different from the first substrate.

5. The indoor unit according to claim 4, wherein an operating device for operating the air conditioner is further mounted on the second substrate.

6. The indoor unit according to claim 2, further comprising an indicating device disposed in a vicinity of the receiving device and configured to display an operating state, the receiving device being disposed behind the indicating device.

7. The indoor unit according to claim 6, wherein the indicating device is mounted on a second substrate different from the first substrate.

8. The indoor unit according to claim 7, wherein an operating device for operating the air conditioner is further mounted on the second substrate.

9. The indoor unit according to claim 1, further comprising an indicating device disposed in a vicinity of the receiving device and configured to display an operating state, the receiving device being disposed behind the indicating device.

10. The indoor unit according to claim 9, wherein the indicating device is mounted on a second substrate different from the first substrate.

11. The indoor unit according to claim 10, wherein an operating device for operating the air conditioner is further mounted on the second substrate.

12. The indoor unit according to claim 10, wherein the first substrate is disposed so as to be inclined with respect to the second substrate.

13. The indoor unit according to claim 12, wherein a front end portion of the first substrate is disposed at a position farther from the first surface than a rear end portion of the second substrate, the front end portion of the first substrate is an upper end portion of the first substrate, and the rear end portion of the second substrate is a lower end portion of the second substrate.

14. The indoor unit according to claim 12, wherein the first substrate is inclined with respect to the second substrate so as to be directed upward in a forward direction.

15. The indoor unit according to claim 14, wherein a front end portion of the first substrate is disposed at a position farther from the first surface than a rear end portion of the second substrate, the front end portion of the first substrate is an upper end portion of the first substrate, and the rear end portion of the second substrate is a lower end portion of the second substrate.

* * * * *